US006604768B2

(12) United States Patent
Stevenson

(10) Patent No.: US 6,604,768 B2
(45) Date of Patent: Aug. 12, 2003

(54) CONCRETE CHUTE SCOOP

(76) Inventor: Mark W. Stevenson, 128 W. Putnam Ferry Rd., Woodstock, GA (US) 30189

( * ) Notice: Subject to any disclaimer, the term of this patent is extended or adjusted under 35 U.S.C. 154(b) by 0 days.

(21) Appl. No.: 09/865,839

(22) Filed: May 25, 2001

(65) Prior Publication Data

US 2002/0175526 A1 Nov. 28, 2002

(51) Int. Cl.[7] ..... B25B 33/00; A47L 25/00

(52) U.S. Cl. ..... 294/55; 294/49; 294/57; 15/236.07; 16/422

(58) Field of Search ..... 294/7, 25, 19.1, 294/32, 49, 50.6, 50.8, 51, 54.5, 55, 56, 57; 15/104.03, 104.05, 105, 236.01, 236.04–236.08, 245; 30/169, 171, 277, 340, 342, 344; 16/422, 430

(56) References Cited

U.S. PATENT DOCUMENTS 3,047,946 A * 8/1962 Lins ..... 30/169 X
3,474,535 A * 10/1969 Kramer ..... 294/49 X
4,064,588 A * 12/1977 Cooper ..... 15/236.08
4,200,948 A * 5/1980 Nesseth ..... 15/105 X
4,574,479 A * 3/1986 Gramann ..... 294/7 X
4,850,728 A * 7/1989 Arroyo ..... 15/236.07 X
4,959,905 A * 10/1990 Ghislain ..... 30/340 X
5,033,156 A * 7/1991 Stewart ..... 15/236.07 X
5,575,315 A * 11/1996 Wengert ..... 294/55 X
5,695,011 A * 12/1997 Daniels ..... 294/55 X

* cited by examiner

*Primary Examiner*—Dean J. Kramer
(74) *Attorney, Agent, or Firm*—Myers & Kaplan, LLC; Sandra M. Sovinski; Joel D. Myers

(57) ABSTRACT

A specialized tool for utilization within the chute of a concrete truck enabling efficient direction of liquid concrete via a raised gripping edge and strategically shaped, replaceable/disposable head, wherein a generally semi-circular shaped head facilitates compatibility with the discharge chute of a cement truck for assisting in the direction and placement of concrete, a gripping edge facilitates a comfortably secure reach into the discharge chute of a cement truck for scooping, pulling, plugging or otherwise controlling the flow of concrete and a replaceable blade head provides long-term efficient usage thereof, thereby enabling a user to efficiently deposit, apply and manage fresh liquid concrete from a concrete truck's chute as the concrete is being discharged.

10 Claims, 4 Drawing Sheets

CONCRETE CHUTE SCOOP

TECHNICAL FIELD

The present invention relates generally to trowel-type tools and, more specifically, to a specialized concrete chute scoop hand tool for use in the discharge chute of a concrete truck, the scoop having a generally semi-circular shaped head and a thumb grip enabling utilization in either the right or left hand of a user. The present invention is particularly useful in, although not strictly limited to, concrete discharge applications wherein an individual desires to assist in the direction and placement of concrete by reaching into the discharge chute of a concrete truck and controlling the flow of concrete by scooping, pulling, sweeping and/or plugging the flow of concrete.

BACKGROUND OF THE INVENTION

It is common practice in the concrete installation industry to have a worker utilize an implement of some sort to assist in the direction of fresh concrete as it is discharged down the elongated chute of a concrete truck. Makeshift tools are often improvised at a job site, wherein a worker may employ a piece of scrap wood, pipe or metal. Other available tools that have also been utilized include spades, sponges and trowels.

Each of the aforementioned tools or devices is inherently inefficient and thus disadvantageous, wherein the shape thereof is not complementary to that of a chute of a concrete truck. Repeated strokes are necessitated to effectively influence the movement of fresh liquid concrete in a chute. These incompatibly shaped tools disadvantageously increase the amount of work energy required to scoop a substantial portion of concrete within a chute.

In addition, concrete is prone to build up on the utilized implements over time. Wherein work site tools are employed to direct fresh concrete in a truck chute, the tools may become unusable for other purposes. So dedicated, the concrete laden tools continue to become increasingly heavy, more inefficient and finally must be discarded. Such continual replacement of tools is financially disadvantageous.

Therefore, it is readily apparent that there is a need for a concrete chute scoop apparatus having a generally semi-circular shaped head enabling compatibility with the discharge chute of a cement truck, a slightly protruding edge grip enabling a comfortably secure reach into the discharge chute of a cement truck and a replaceable blade head enabling long-term efficient usage thereof, thus preventing the above-discussed disadvantages.

BRIEF SUMMARY OF THE INVENTION

Briefly described, in a preferred embodiment, the present invention overcomes the above-mentioned disadvantages, and meets the recognized need for such a device, by providing a concrete chute scoop device enabling efficient direction of liquid concrete via a protruding edge hand-grip and strategically shaped, replaceable/disposable head.

According to its major aspects and broadly stated, the present invention is a specialized scoop apparatus having a generally semi-circular shaped head facilitating compatibility with the discharge chute of a cement truck for assisting in the direction and placement of concrete, a gripping edge facilitating a comfortably secure reach into the discharge chute of a cement truck for scooping, pulling, plugging or otherwise controlling the flow of concrete and a replaceable blade head providing long-term efficient usage thereof, thereby enabling a user to efficiently deposit, apply and manage fresh liquid concrete from a concrete truck's chute as the concrete is being discharged.

More specifically, the present invention is a substantially flat blade having a first substantially arcuately extended edge. The dimensions of the arcuately extended edge are defined to correlate directly with the dimensions of the "U"-shaped interior of the chute of a concrete mixing and dispensing truck. Wherein telescoping lengths of a concrete truck chute may have varied interior dimensions, several sizes of the blade of the present invention are provided.

The substantially arcuately extended edge imparts a generally half-circle, or semi-circular, shape to the work end of the blade. This half-moon design makes the task of moving material, such as fresh liquid concrete, easier and simpler by matching the shape of the work chute and thereby enabling contact with all exposed surfaces thereof. The blade is preferably formed from plastic. However, one skilled in the art would readily recognize that alternative materials could be utilized such as, for exemplary purposes only, rubber, fiberglass, metal, wood or composite material.

The blade is affixed to a support member, wherein the support member has a first substantially flat surface and a second substantially quarter round surface. The blade of the present invention may be integral to or permanently affixed to the support member, however, it is preferred that the blade is removably affixed to facilitate replacement thereof. The first substantially flat surface of the support member provides the work surface to contact the chute material. The second substantially quarter round surface of the support member provides a raised thumb grip for the user's hand.

A feature and advantage of the present invention is the ability of such a device to provide assistance in the unloading of fresh concrete.

A feature and advantage of the present invention is the ability of such a device to enable a worker to work in a more efficient manner, utilizing fewer strokes thus reducing the amount of time and effort needed for the task of moving fresh concrete in a concrete chute.

A feature and advantage of the present invention is the ability of such a device to fit within a pocket of a user, enabling hands-free portability thereof.

A feature and advantage of the present invention is the ability of such a device to provide a specialized tool for handling fresh concrete, wherein a disposable blade extends the useful life thereof.

A feature and advantage of the present invention is the ability of such a device to enable efficient direction and placement of liquid concrete.

A feature and advantage of the present invention is the ability of such a device to effectively mate with the "U"-shaped interior of the chute of a concrete mixing and dispensing truck.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
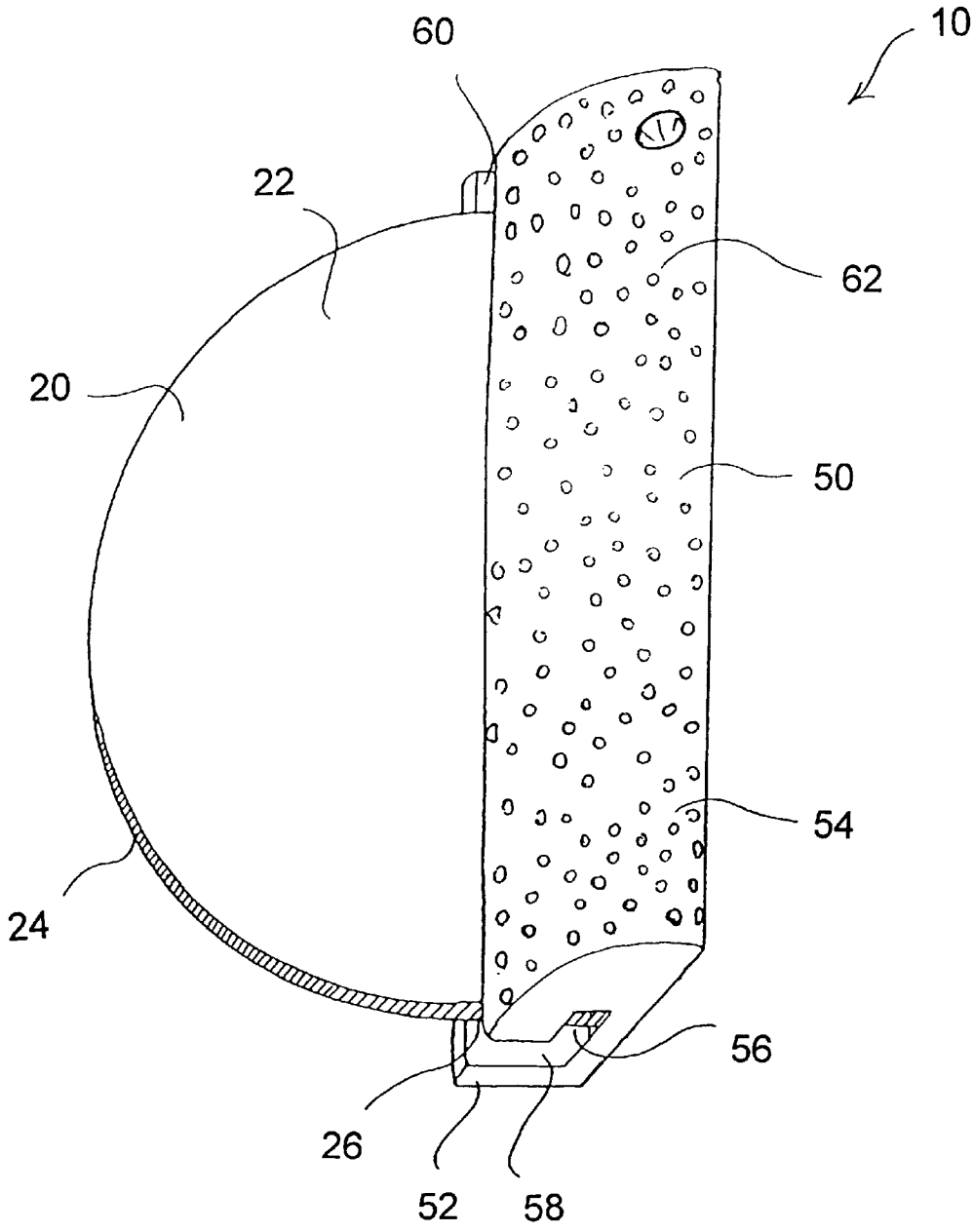
FIG. 1 is a perspective view of a concrete chute scoop apparatus according to a preferred embodiment of the present invention.
Figure 3:
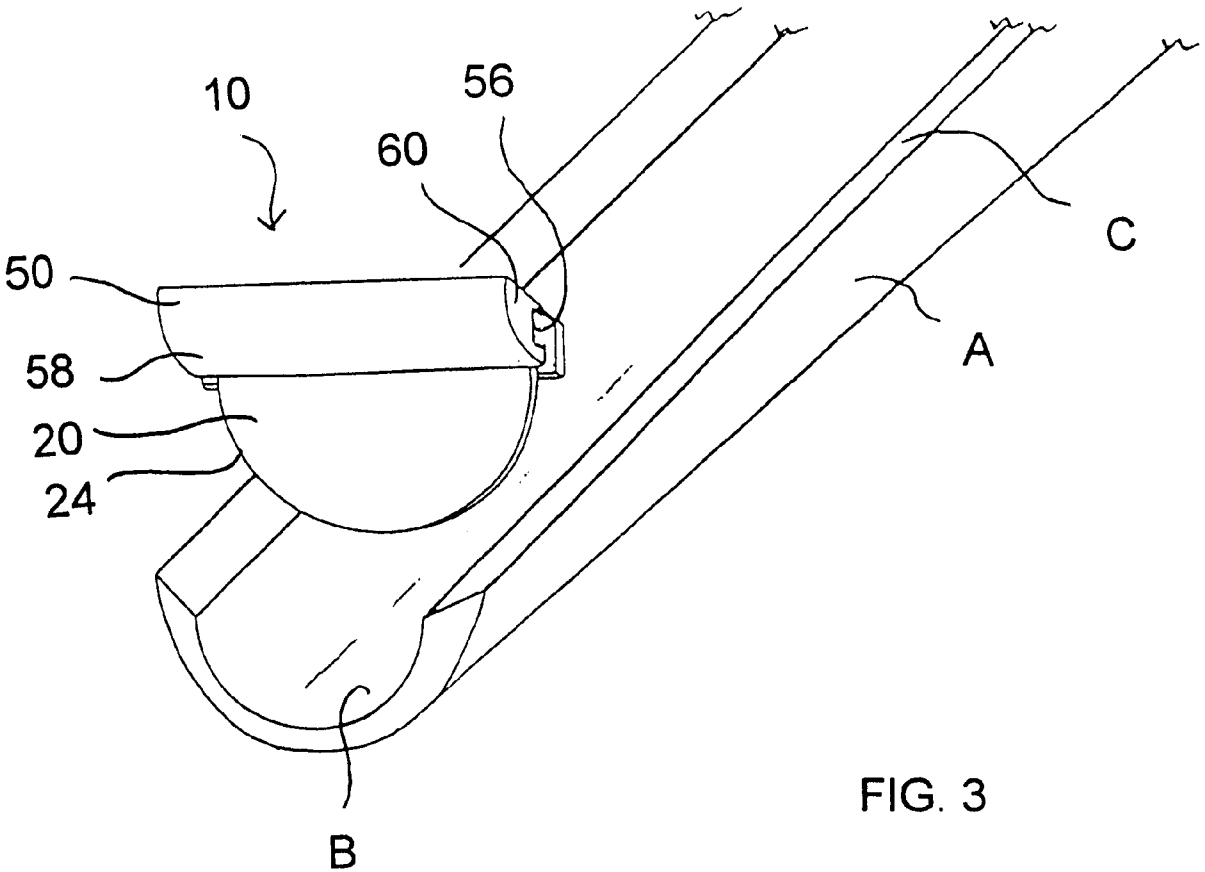
FIG. 3 is a perspective view of the concrete chute scoop apparatus of FIG. 1, showing the concrete chute scoop positioned above a dispensing chute of a concrete truck.

Referring now to FIG. 1, the present invention is a concrete chute scoop device 10 generally comprising scoop member 20 and scoop support 50. Preferably, scoop member 20 is a substantially flat blade 22 defined by substantially arcuate extended edge 24 and substantially straight support edge 26. As best seen in FIG. 3, the dimensions of first substantially arcuate extended edge 24 preferably correspond with known dimensions of substantially "U"-shaped interior B of a concrete mixing and dispensing truck chute A. Wherein telescoping or pivoting sections of a concrete truck chute have interior dimensions enabling stacked or interlocked placement thereof, several sizes of scoop member 20 of concrete chute scoop device 10 are provided. One skilled in the art would readily recognize based on the present disclosure that while the preferred embodiment of scoop member 20 is dimensioned to correspond with the interior space of known concrete chutes, other dimensions could be utilized to correspond with other types of material troughs and dispensing chutes.

Preferably, substantially straight support edge 26 of scoop member 20 is removably carried by scoop support 50. Preferably, scoop support 50 is substantially rectangular shaped with substantially flat scoop side 52 and substantially quarter-round grip side 54. While quarter-round shaped grip side 54 is preferred to enable comfortably secure holding of concrete chute scoop apparatus 10, other grip shapes could be utilized such as, for exemplary purposes only, a substantially rectangular shaped grip or a free-form shaped grip with a plurality of finger receptacles provided therein.

Figure 4:
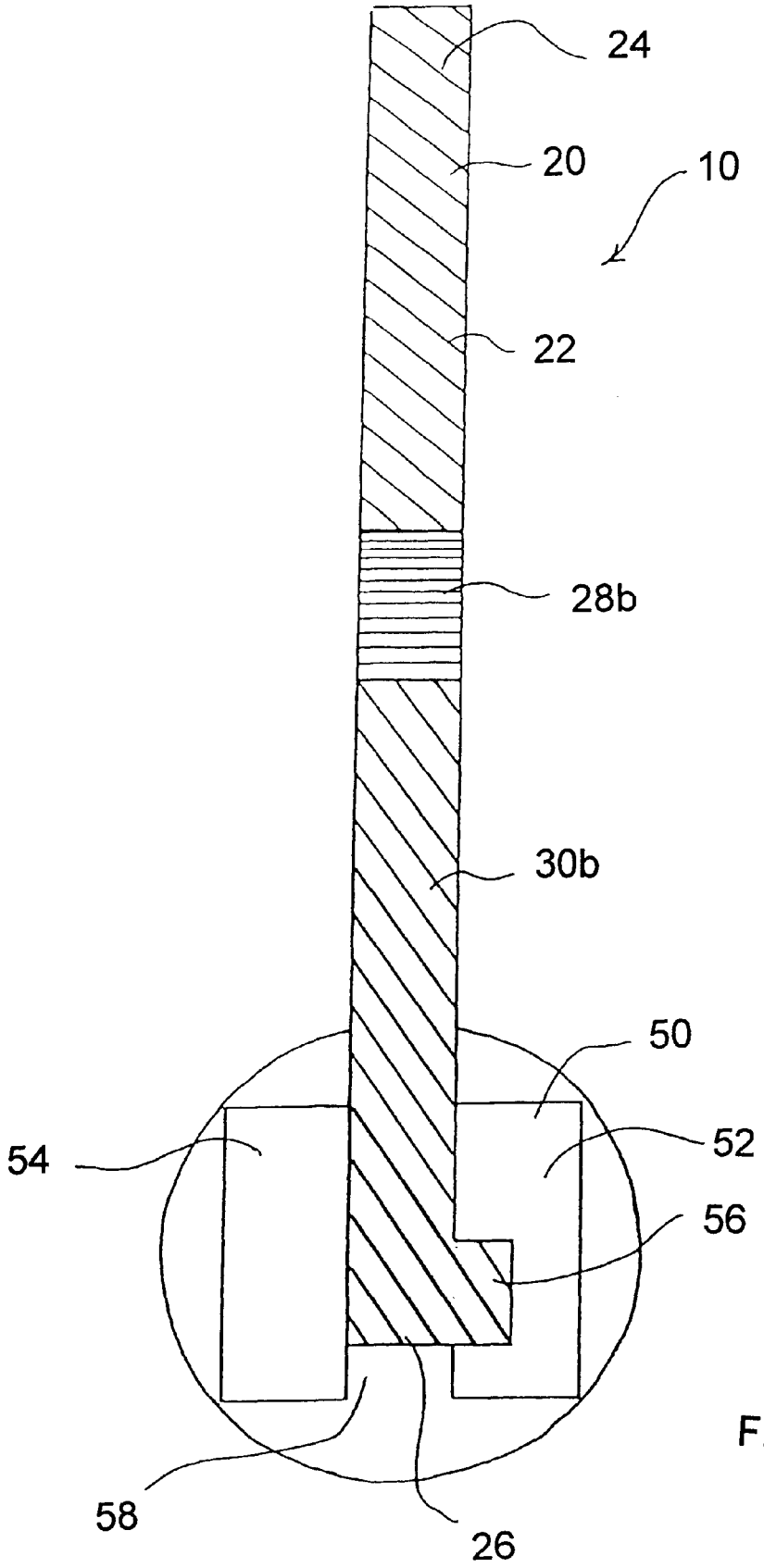
FIG. 4 is a side view of the concrete chute scoop apparatus of FIG. 2.

Preferably, scoop support 50 is grooved, wherein the dimensions of groove 56 enable substantially straight support edge 26 of scoop member 20 to be slidably placed and held therein, as best seen in FIG. 4. Preferably, first end 58 of groove 56 permits access thereto for placement and removal of scoop member 20, wherein second end 60 of groove 56 prevents passage of scoop member 20, thus enabling secure positioning of scoop member 20 within support member 50. Preferably, the length of support member 50 is greater than the length of scoop member 20, wherein first end 58 and second end 60 extend outwardly therefrom thereby providing a support function during use of concrete chute scoop apparatus 10 by contacting the upper edge C of the trough region B of a concrete truck chute A, as best seen in FIG. 3.

Preferably, scoop member 20 is plastic, thereby facilitating disposal and replacement thereof. However, one skilled in the art would readily recognize that alternative materials could be utilized such as, for exemplary purposes only, rubber, fiberglass, metal, wood or composite material. Support member 50 is preferably formed from lightweight yet sturdy metal such as, for exemplary purposes only aluminum. However, one skilled in the art would readily recognize that other suitably strong, yet portable materials could be utilized such as, for exemplary purposes only, plastic, fiberglass, wood or other synthetic composite material.

In an alternate embodiment, scoop member 20 could be permanently affixed to support member 50.

In an alternate embodiment, scoop member 20 could be integrally formed with support member 50.

In an alternate embodiment, support member 50 could carry a locking hinge-type mechanism wherein scoop member 20 could be securely and replaceably retained thereby.

In an alternate embodiment, outer surface 62 of support member 50 could carry striations, grooves, rubber or other grip-enhancing feature.

In an alternate embodiment, first end 58 or second end 60 of support member 50 could have an aperture defined therethrough or a looping member carried thereon, thereby enabling convenient hanging placement of concrete chute scoop apparatus 10.

Figure 2:
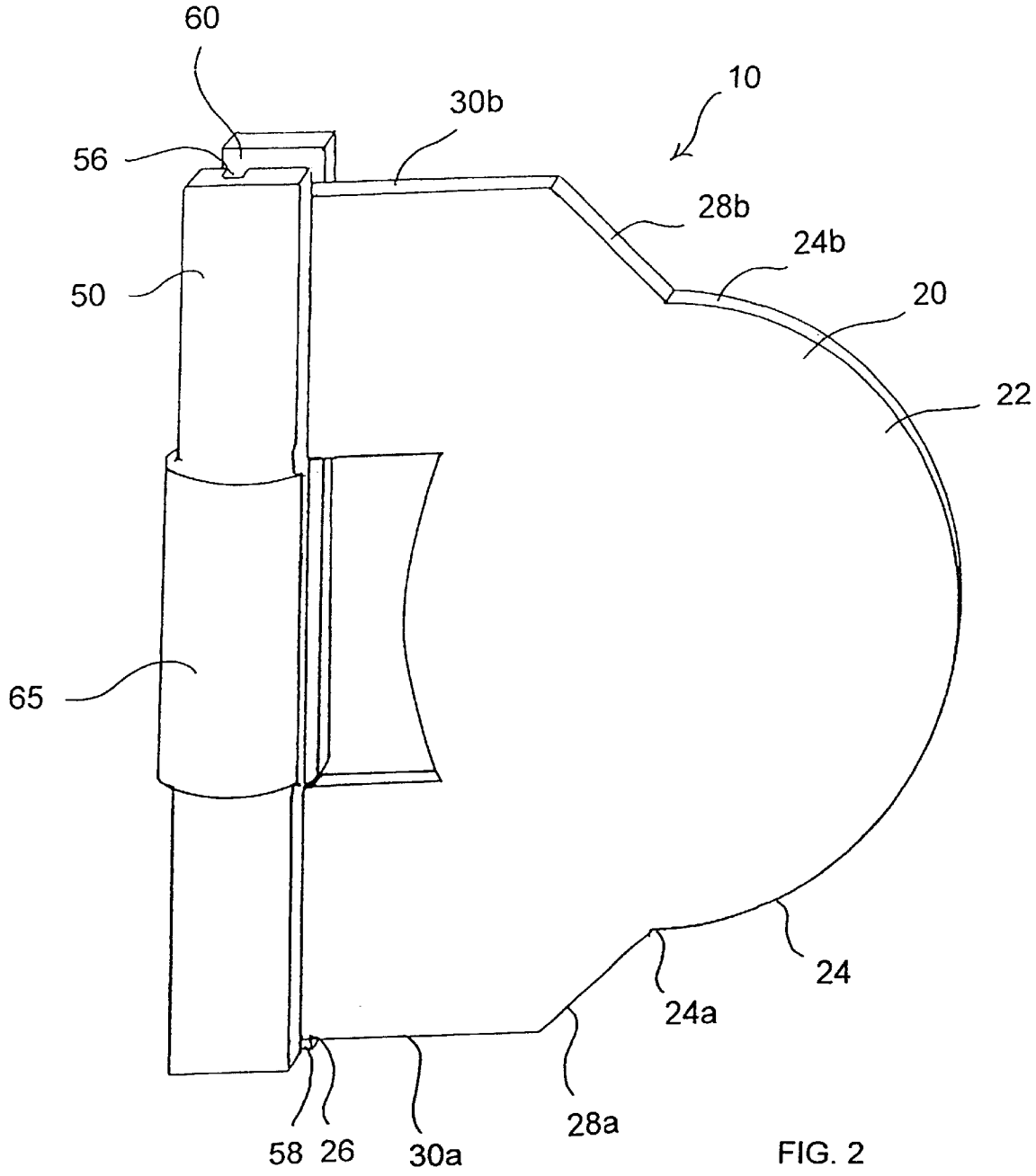
FIG. 2 is a perspective view of a concrete chute scoop apparatus according to an alternate embodiment of the present invention.

In an alternate embodiment, best seen in FIG. 2, support member 50 could be substantially flat with a substantially cylindrical shaped grip region 65 and blade member 20 could have a first end 24*a* and second end 24*b* of substantially arcuate extended edge 24, wherein a first guiding edge 28*a* and second guiding edge 28*b* could intersect therewith, respectively, and wherein guiding edges 28*a* and 28*b* could extend outwardly from substantially arcuate extended edge 24 and at an angle thereto, thereby providing a support function during use of concrete chute scoop apparatus 10 by contacting the upper edge of the trough region of a concrete truck chute. First side edge 30*a* and second side edge 30*b* could extend, substantially straight, from outwardly angled guiding edges 28*a* and 28*b*, respectively, to substantially straight support edge 26. Other formations of guiding edges 28*a* and 28*b* could also be utilized such as, for exemplary purposes only, a substantially straight, non-angled formation, an arcuately recessed formation, an arcuately extended formation or a grooved formation. Furthermore, scoop member 24 could be alternatively defined wherein guiding edges 28*a* and 28*b* extend, outwardly angled, to substantially straight support edge 26, thereby effectively eliminating first side edge 30*a* and second side edge 30*b*.

In use, concrete chute scoop apparatus 10 aids in the placement of concrete for building walkways, concrete floors and other areas where beds of concrete are being laid, wherein a user grasps support member 50 with his or her thumb adjacent to substantially quarter-round grip edge 54, thereby comfortably reaching up into the discharge chute of a cement truck. The user directs the substantially arcuate extended edge 24 into the inner "U"-shaped trough of the concrete chute. User controlled movement support member 50 directs scoop member 20 for scooping, pulling, plugging or otherwise controlling the flow of concrete. When scoop member 20 becomes worn, the user easily removes scoop member 20 from support member 50, sliding in a replacement and thus avoiding discarding the entire tool.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A scoop device for a concrete chute, comprising:

a scoop member having a substantially arcuate, generally blunt outer edge and a substantially straight support edge; and an elongated side with a receiving trough, a second substantially flat elongated side, a third substantially flat elongated side, a first end, and a second end, wherein said first substantially arcuate elongated side, said second substantially flat elongated side and said third substantially flat elongated side define a cross-sectional shape is approximately a right-angle triangle having a convex hypotenuse, wherein said substantially straight support edge of said scoop member is longitudinally carried within said receiving trough of said first substantially arcuate side, and wherein said substantially arcuate, generally blunt outer edge of said scoop member has a longitudinal length approximately equivalent to the distance between said first end of said elongated support member and said second end of said elongated support member.

2. The scoop device for a concrete chute of claim 1, wherein said scoop member is removably carried by said support member.

3. The scoop device for a concrete chute of claim 2, wherein said scoop member is slidably received by said support member.

4. The scoop device for a concrete chute of claim 1, wherein said support member carries a grip thereon.

5. The scoop device for a concrete chute of claim 1, wherein said support member carries at least one hanging port.

6. The scoop device for a concrete chute of claim 1, wherein said support member has at least one gripping means provided thereon.

7. A chute scoop, comprising:

a blade member having a first substantially flat surface, a second substantially flat surface, and a first rounded end with a substantially blunt edge;

a receiving member, said receiving member having a receptacle defined longitudinally therein for removably receiving said blade member lengthwise therein, and said receiving member having a first substantially quarter-round side and a hand-grip provided thereon, wherein said first substantially flat surface of said blade member is carried proximate to said quarter-round side of said receiving member.

8. The chute scoop of claim 7, wherein said hand-grip on said receiving member has at least one grip-enhancement carried thereon.

9. The chute scoop of claim 7, further comprising at least one hanging aperture.

10. A trough tool for utilization in a dispensing chute of a concrete truck, comprising:

a blade member having a first substantially dull rounded end and a mounting end; and a receiving member, said receiving member having a first generally curved outer surface, a second generally planar outer surface, and a third generally planar out surface, said receiving member having an elongated receptacle defined therein for longitudinally, slidably and removably receiving said mounting end of said blade member, wherein said first substantially dull rounded end of said blade member extends arcuately from said receiving member, wherein a first flat surface of said blade member is positioned proximate to said first generally curved outer surface of said receiving member, wherein a second flat surface of said blade member is positioned proximate to said second generally planar outer surface of said receiving member, and wherein said mounting end of said blade member is positioned within said receiving member proximate to and inner surface of said third generally planar outer surface of said receiving member and has a longitudinal length approximately equivalent to that of said receiving member.

* * * * *